United States Patent [19]

Lovell

[11] 3,934,745

[45] Jan. 27, 1976

[54] SAFETY BOTTLE CAP

[76] Inventor: Walter C. Lovell, 348 Mountain St., Wilbraham, Mass. 01095

[22] Filed: Sept. 16, 1974

[21] Appl. No.: 506,170

Related U.S. Application Data

[63] Continuation-in-part of Ser. No. 315,608, Dec. 15, 1972, abandoned.

[52] U.S. Cl. ..... 215/224; 220/281

[51] Int. Cl.[2] ..... B65D 55/02; B65D 85/56; A61H 1/00

[58] Field of Search ..... 215/224, 225, 9; 220/281

[56] References Cited

UNITED STATES PATENTS

| | | | |
|---|---|---|---|
| 3,434,614 | 3/1969 | Moller | 215/224 |
| 3,484,016 | 12/1969 | Turner | 220/281 |
| 3,718,230 | 2/1973 | James | 220/281 |
| 3,853,237 | 12/1974 | Marchant | 215/224 |

*Primary Examiner*—George T. Hall
*Attorney, Agent, or Firm*—Charles R. Fay

[57] ABSTRACT

A safety closure cap for wide mouth bottles or jars comprising a domed central portion with a depending inwardly directed flange at the periphery thereof, a series of mutually spaced circumferentially arranged slots in said flange; the bottle having a rim and below the rim there is an annular groove defined at both sides by lips sloping up to the edges of the groove, the edge of the flange on the safety cap snapping into said groove and being located in overlapped relation to one of said lips so that it is substantially protected thereby against prying.

2 Claims, 4 Drawing Figures

SAFETY BOTTLE CAP

RELATED APPLICATION

This application is a continuation in part of Ser. No. 315,608, filed Dec. 15, 1972, now abandoned.

BACKGROUND OF THE INVENTION

One of the problems in the pharmaceutical industry resides in the provision of safety caps for containers for poisons or other dangerous materials, particularly with regard to children too young to understand the poison symbol or to read warnings. Many suggestions have been made in this connection but most of the prior art constructions are too expensive and complicated for every day use, and it is the particular object of the present invention to provide a safety closure cap which cannot be removed by children wherein said closure cap is a simple one-piece plastic part.

There is the well known palm and turn cap which in most cases is difficult even for an adult to operate. There is also the overcap type which is expensive because it uses two cap parts.

The present invention is directed to the type of safety cap wherein a substantially self-sustaining but deformable upwardly extending dome is adapted to be pressed downwardly centrally thereof to release interengaging means at the edge of the container so that the cap may be removed, and in order to replace, it merely has to be snapped on.

One example of this type of cap is U.S. Pat. No. 3,484,016, which however is not a safety cap because of the fact that it releases with only one motion and is therefore not safe, whereas in safety caps, two motions are necessary. In the patent identified, when pressure is applied as described therein, the surrounding continuous skirt at 16 moves generally upwardly on fulcrum 18*a* for instance, thus merely be pressing down on the dome the entire cap is immediately released.

Referring to column 3, lines 38 et seq of this patent, it is described that there may be a possibility that the cover member (periphery of the cap) may not quite clear the curved surface around the outside of the mouth portion of the container, and if this happens the cover member may be removed by the application of lateral pressure as indicated by the arrow 26*a* in FIG. 5, but this is not expected to occur. The principal object of the invention in the patent is to release the cap by a single motion as shown by arrow 19 in FIG. 2. In any event it will be clear in FIG. 5 that the skirt 16 rises and rises either above the surrounding curved surface 13 or opposite it, so that the cover is actually fully released. Also in the patent the same is rather difficult to operate because of the fact that the skirt 16 is continuous and it has to stretch in order to move from the FIG. 1 condition thereof into the FIG. 2 condition thereof. It can stretch to some extent because it is made of rubber, but when made of flexible plastic material such as polyethelene it often fails to operate and is broken under excessive pressure used at 19 in FIG. 2 to try to operate it. If pressure is released from the dome the cover will come off without further effort, at least that is what it is expected to do.

All of these objections are avoided by the present invention in which the cover is not completely dislocated from the container by the application of pressure downwardly on the dome thereof. If the pressure is released the cap periphery moves back into locking engagement with respect to the container so it will be seen that in the present invention a true safety device is presented which definitely requires two motions and usually two hands in order to operate it. In addition in the present case, slits are utilized in the surrounding skirt and this makes the operation easier although it does not in any case cause the cover to be released by a single motion as in the patent identified.

SUMMARY OF THE INVENTION

The safety cap in the present invention comprises a domed flexible but self-sustaining molded plastic member having an edge flange which is directed on a slant inwardly, said flange terminating in a relatively thin edge. The flange is slotted in mutually spaced positions circumferentially thereof to render it more flexible.

A special bottle is used in connection with the safety cap, the bottle having a wide mouth. This wide mouth is provided with a rim having an edge with slants in a direction downwardly away from the mouth; and in spaced relation thereto there is a complementary spaced lip which slants upwardly and away from the container, these lips defining between them a relatively deep peripheral groove into which the relatively thin edge of the flange on the bottle cap is easily snapped, the thin edge of the flange being substantially covered by one of said lips so that it is not free for prying as by a fingernail or pick of any kind but is protected against such actions by being substantially overlapped.

In the use of the present device the domed part is pushed down manually at the center thereof thus causing the flange to spread outwardly in the position where another motion upwardly on any portion of the periphery of the cap is necessary to remove it, but at the same time should pressure be released before this second action is accomplished, the flange will snap back into the groove relocking the top in position without any further action on the part of the user and therefore it is seen that such a device although easily activated by an adult is almost impossible to be opened by an infant.

PREFERRED EMBODIMENT OF THE INVENTION

Figure 2:
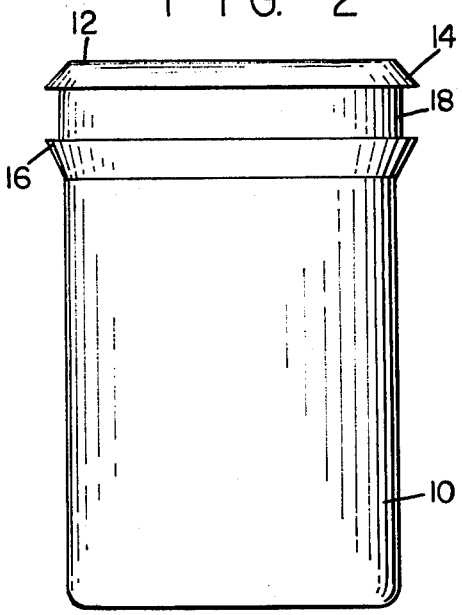
FIG. 2 is a view in elevation showing the rim of the bottle.

The reference numeral 10 indicates a container which may be of any suitable material e.g., plastic. As shown in FIG. 2 it is provided with a wide mouth having a rim at 12, defined by a lip 14 which extends downwardly and outwardly on a slant as clearly shown. Spaced downwardly from this rim there is an outwardly and upwardly extending lip 16 complementary thereto, these two lips defining between them a groove 18.

Figure 1:
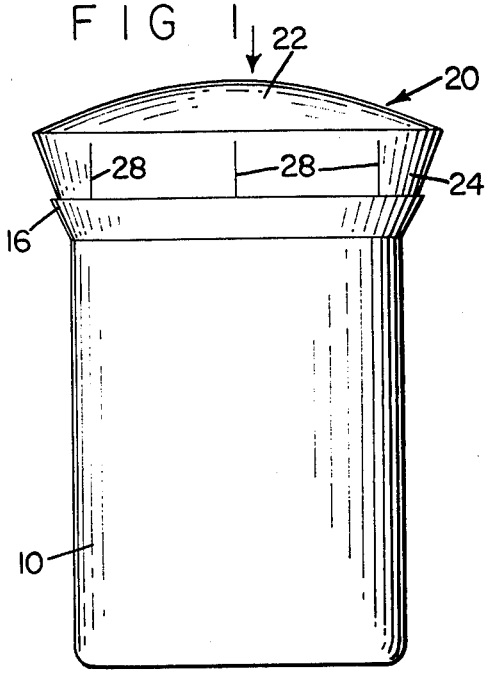
FIG. 1 is a view in elevation with the cap in place on the bottle.
Figure 3:
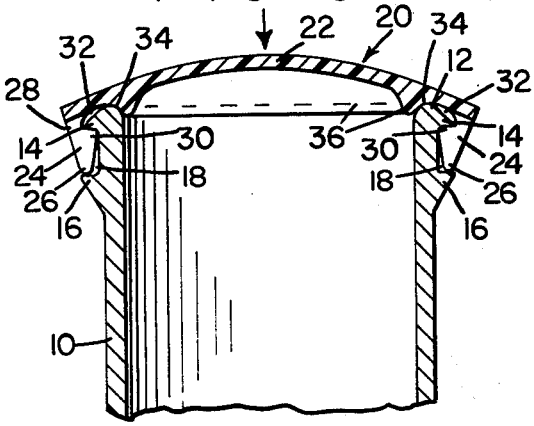
FIG. 3 is a sectional view through the bottle with the cap in position.
Figure 4:
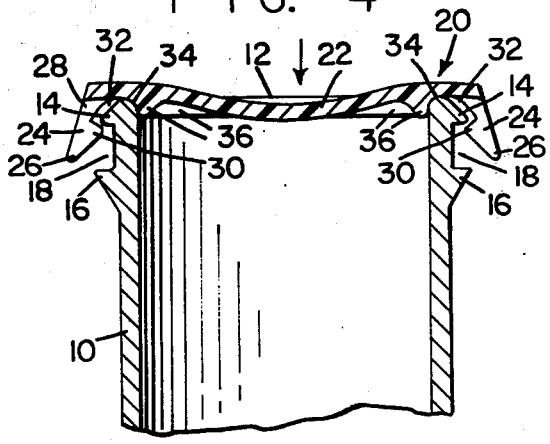
FIG. 4 is a similar view showing the flange spread out under downward pressure on the domed portion of the cap.

The cap is generally indicated by the reference numeral 20. It is provided with a central dome 22 and is preferably made of a resilient, yielding but self-sustaining plastic so that the dome can be flexed downwardly in the direction of the arrows in FIGS. 1, 3, and 4. FIGS. 1 and 3 show the normal closed position of the cap and FIG. 4 shows the cap in condition to be removed.

The cap is provided with an inwardly slanting peripheral flange 24 which terminates in a thin edge 26, which might be referred to as a "feather" edge. The flange 24 is provided with a series of spaced slots 28, see FIG. 1, extending to the feather edge 26, to make the flange 24 more flexible and more easily operated as will be described.

The flange 24 has a peripheral inwardly directed shoulder 30 formed by an annular groove 32 at the interior of the flange, and this forms a continuous "arrowhead" or the like, with edge 26, except for the interruptions caused by slots 28. The groove 32 is substantially reentrant as at 34, forming a rounded ridge 36 that is continuous and annular, and in effect faces the shoulder 30.

The cap is easily applied to the bottle merely by pushing it onto and over the slanting lip 14, the flange snapping over this lip, so that the feather edge 26 comes to rest in groove 18 substantially against the inside aspect of lip 16, see FIG. 3. The shoulder 30 snaps under lip 14, forming a continuous positive lock all about the rim of the container, the continuous ridge 36 forms a seal between the closure cap and the mouth of the container. In this condition the bottle is locked shut, and it will be seen that the feather edge 26 cannot be picked at because it is substantially covered by the lip 16. The cap cannot be pulled out because the shoulder 30 extends inwardly under the edge of lip 14.

In order to move the cap it is necessary to push downwardly on the dome in the direction of the arrows in FIGS. 1, 3, and 4, to distort the dome 22 so that it will appear as in FIG. 4, in which case the flange is forced to spread outwardly, and in this condition the cap is easily removed. This is done by holding the bottle between the forefinger and the adjacent finger with the cap under the thumb, pressing down with the thumb to distort the cap from the FIG. 3 to the FIG. 4 position, and then pulling upwardly on the now outstanding rim 24 with the fingers at any location circumferentially of the cap. This action takes two hands, but after practise, it may be done with but one hand, but still the two separate actions are required. No infant would be able to do this, and should the dome be pressed accidentally, it will be released at some time, and the cap snap back on the container, closing it.

In further explanation of the safety action of the new cap, the ridge 36 acts as a fulcrum at the inside aspect of the mouth of the container, at 34, not on the top of the rim. Therefore the locking shoulder 30 as well as the entire flange at 24, moves outwardly but not upwardly, and thus is not really released from shoulder 14, so that should the pressure on the dome be released, the flange and shoulder snap back into locked position. This outward motion is possible because of slits 28, which break the flange 24 into segments that can move independently of each other.

Therefore it will be seen that it is definitely necessary to use two complete and different motions in order to release the cap from the container in the present invention. First the dome must be depressed, see the arrow in FIG. 4, but while the finger maintains the dome thus depressed another finger usually on the other hand must engage the feather edge 26 and move it generally longitudinally with respect to the axis of the container. This can be done at any point around the edge of the flange 24 and does not have to be done at any particular locality or position. Nevertheless it is necessary to be done as an inspection of FIG. 4 will show because the shoulder at 30 is really not completely disengaged from the lip at 14, even though the dome is strongly pressed.

If the pressure indicated by the arrow is relaxed the resiliency of the cap will cause the shoulder at 30 to snap back under lip 14 so that the container is once more closed as shown in FIG. 3.

I claim;

1. A safety closure for a bottle, said bottle having an open rim defined by a lip, said lip having an outwardly extending portion, a complementary lip in spaced relation to the outwardly extending portion of the first named lip, said lips defining a groove between them, said first named lip having a reaction surface at the inner side of the bottle, opposite the outwardly extending portion of the first named lip, the closure comprising a cap of a deformable resilient and substantially self-sustaining plastic material including a main closed portion in the form of a dome, an inwardly inclined flange depending therefrom at the periphery thereof, said flange being constructed and arranged to snap over the first named lip to enter the groove to close the bottle, a series of slots in the flange in mutually spaced relation circumferentially of the flange providing for expansion of the flange upon pressure downwardly applied to the dome to a position wherein the flange substantially clears the outwardly extending portion of the first named lip, and a downwardly extending generally circular ridge at the inside portion of said cap, said ridge being spaced inwardly from the flange and forming a fulcrum, said fulcrum normally bearing on said reaction surface and causing the flange to pivot outwardly upon the application of the downward pressure on the dome aforesaid.

2. The safety closure of claim 1 wherein said flange has a peripheral thin edge conforming to the complementary lip, the latter overlapping the thin edge in relaxed condition of the cap.

* * * * *